US009713411B2

(12) United States Patent
Gardner et al.

(10) Patent No.: US 9,713,411 B2
(45) Date of Patent: Jul. 25, 2017

(54) SURFACE-TREATMENT APPARATUS AND HEAD UNIT

(71) Applicant: The Kirby Company / Scott Fetzer Company, Cleveland, OH (US)

(72) Inventors: Joseph S. Gardner, Euclid, OH (US); Diane L. Dodson, Sagamore Hills, OH (US); David B. Rennecker, Canton, OH (US); John T. Lackner, Independence, OH (US); John R. Crossen, Brookpark, OH (US)

(73) Assignee: The Kirby Company / Scott Fetzer Company, Cleveland, OH (US)

( * ) Notice: Subject to any disclaimer, the term of this patent is extended or adjusted under 35 U.S.C. 154(b) by 472 days.

(21) Appl. No.: 14/518,635

(22) Filed: Oct. 20, 2014

(65) Prior Publication Data

US 2016/0106286 A1 Apr. 21, 2016

(51) Int. Cl.
*A47L 11/40* (2006.01)
*A47L 11/292* (2006.01)

(52) U.S. Cl.
CPC ..... *A47L 11/4036* (2013.01); *A47L 11/292* (2013.01); *A47L 11/4041* (2013.01); *A47L 11/4083* (2013.01); *A47L 11/4088* (2013.01)

(58) Field of Classification Search
CPC ..... A47L 11/4036; A47L 11/4041; A47L 11/4083; A47L 11/4088; A47L 11/292
See application file for complete search history.

(56) References Cited

U.S. PATENT DOCUMENTS

| | | | |
|---|---|---|---|
| 192,906 | A | 7/1877 | Ellis |
| 275,136 | A | 4/1883 | Butler |
| 320,491 | A | 6/1885 | Mitchell |
| 328,166 | A | 10/1885 | Williams |
| 392,779 | A | 11/1888 | Bunch |
| 396,902 | A | 1/1889 | Stukes et al. |
| 600,868 | A | 3/1898 | Handshy |
| 608,546 | A | 8/1898 | Coburn |
| 672,104 | A | 4/1901 | Palmer |
| 1,368,833 | A | 2/1921 | Piechowicz |
| 1,402,924 | A | 1/1922 | Doughty |
| 1,422,100 | A | 7/1922 | Hoff |

(Continued)

FOREIGN PATENT DOCUMENTS

| | | | |
|---|---|---|---|
| DE | 102007052982 | A1 | 5/2009 |
| EP | 1195127 | A2 | 4/2002 |

(Continued)

OTHER PUBLICATIONS

Spisich, Mark; Non-Final Office Action issued in U.S. Appl. No. 14/186,943; dated Dec. 23, 2016; 9 pages.

(Continued)

*Primary Examiner* — Dung Van Nguyen
(74) *Attorney, Agent, or Firm* — Ulmer & Berne LLP

(57) ABSTRACT

A head unit for a surface-treatment apparatus is provided and includes a housing that includes a fluid inlet, a dispensation unit, and at least one baffle. The fluid inlet receives fluid from a fluid reservoir. The dispensation unit defines a dispensation chamber and an input port in fluid communication with each of the dispensation chamber and the fluid inlet. The at least one baffle is configured to direct the flow of fluid through the dispensation unit and out of the elongated dispensation outlet.

18 Claims, 9 Drawing Sheets

(56) References Cited

U.S. PATENT DOCUMENTS

| | | | |
|---|---|---|---|
| 1,530,930 | A | 3/1925 | Burch |
| 1,531,701 | A | 3/1925 | Jossart |
| 1,570,127 | A | 1/1926 | Burch |
| 1,797,119 | A | 3/1931 | Beckwith |
| 1,938,068 | A | 12/1933 | Deutscher |
| 1,947,136 | A | 2/1934 | Moorhead |
| 2,041,140 | A | 5/1936 | Moorhead |
| 2,498,205 | A | 2/1950 | Goldenberg |
| 2,635,277 | A | 4/1953 | Belknap |
| 2,745,551 | A | 5/1956 | Schmid |
| 3,370,315 | A | 2/1968 | MacFarland et al. |
| 3,377,639 | A | 4/1968 | Stevenson |
| 3,789,449 | A | 2/1974 | MacFarland et al. |
| 4,041,567 | A | 8/1977 | Burgoon |
| 4,115,890 | A | 9/1978 | Burgoon |
| 4,191,792 | A | 3/1980 | Janssen |
| 4,235,465 | A | 11/1980 | Costello |
| 4,404,703 | A | 9/1983 | Woodall, Jr. et al. |
| 4,458,377 | A | 7/1984 | Frohbieter |
| D275,136 | S | 8/1984 | Bowers |
| 4,573,235 | A | 3/1986 | Baird et al. |
| 4,847,944 | A | 7/1989 | Lackner |
| 4,914,777 | A | 4/1990 | Cartellone |
| 4,947,512 | A | 8/1990 | Lackner et al. |
| 4,989,293 | A | 2/1991 | Bashyam |
| 5,007,133 | A | 4/1991 | Lackner et al. |
| 5,014,387 | A | 5/1991 | Hays |
| 5,018,240 | A | 5/1991 | Holman |
| D320,491 | S | 10/1991 | Lackner et al. |
| 5,086,536 | A | 2/1992 | Lackner et al. |
| 5,115,537 | A | 5/1992 | Meyer et al. |
| D328,166 | S | 7/1992 | Lackner et al. |
| 5,137,595 | A | 8/1992 | Garcia |
| 5,193,243 | A | 3/1993 | Stegens |
| 5,272,785 | A | 12/1993 | Stegens |
| 5,308,288 | A | 5/1994 | Lackner et al. |
| 5,373,603 | A | 12/1994 | Stegens |
| 5,465,451 | A | 11/1995 | Stegens |
| 5,483,726 | A | 1/1996 | Blase et al. |
| D371,654 | S | 7/1996 | WoRwag |
| 5,555,587 | A | 9/1996 | Guha |
| 5,573,369 | A | 11/1996 | Du |
| 5,598,600 | A | 2/1997 | Stegens |
| D380,882 | S | 7/1997 | Rorke et al. |
| 5,711,047 | A | 1/1998 | Armaly |
| 5,713,810 | A | 2/1998 | Fedorka et al. |
| D392,779 | S | 3/1998 | Fedorka et al. |
| D396,902 | S | 8/1998 | Fedorka et al. |
| D398,097 | S | 9/1998 | Murphy et al. |
| D406,928 | S | 3/1999 | Rowley et al. |
| 5,960,514 | A | 10/1999 | Miller et al. |
| 6,003,198 | A | 12/1999 | Stegens |
| 6,012,200 | A | 1/2000 | Murphy et al. |
| 6,041,472 | A | 3/2000 | Kasen et al. |
| D426,356 | S | 6/2000 | Tsuruha |
| D429,392 | S | 8/2000 | Maruyama et al. |
| 6,167,586 | B1 | 1/2001 | Reed et al. |
| 6,175,985 | B1 | 1/2001 | Chambers et al. |
| 6,192,549 | B1 | 2/2001 | Kasen et al. |
| 6,199,279 | B1 | 3/2001 | Humphrey et al. |
| 6,231,711 | B1 | 5/2001 | Roberts et al. |
| 6,286,181 | B1 | 9/2001 | Kasper et al. |
| 6,367,120 | B2 | 4/2002 | Beauchamp |
| 6,401,294 | B2 | 6/2002 | Kasper |
| D462,813 | S | 9/2002 | Nakano et al. |
| 6,532,619 | B2 | 3/2003 | Kasper et al. |
| 6,574,823 | B1 | 6/2003 | Stegens |
| 6,591,440 | B2 | 7/2003 | Stegens et al. |
| 6,591,441 | B2 | 7/2003 | Stegens et al. |
| 6,662,402 | B2 | 12/2003 | Giddings et al. |
| 6,735,812 | B2 | 5/2004 | Hekman et al. |
| 6,760,952 | B1 | 7/2004 | Stegens |
| 6,779,231 | B1 | 8/2004 | Stegens et al. |
| D510,465 | S | 10/2005 | Takahashi et al. |
| D531,770 | S | 11/2006 | Luebbering et al. |
| 7,153,371 | B2 | 12/2006 | Hansen et al. |
| D561,959 | S | 2/2008 | Hahn |
| 7,455,499 | B2 | 11/2008 | Zahuranec |
| D591,918 | S | 5/2009 | Vagges |
| D600,868 | S | 9/2009 | Rennecker et al. |
| D608,546 | S | 1/2010 | Dicker et al. |
| D610,317 | S | 2/2010 | Lee et al. |
| D612,114 | S | 3/2010 | Ikeno |
| 7,794,516 | B2 | 9/2010 | McAllise et al. |
| 7,845,045 | B2 | 12/2010 | Lenkiewicz et al. |
| 7,862,623 | B1 | 1/2011 | Hansen et al. |
| 7,979,952 | B2 | 7/2011 | Beskow et al. |
| D652,589 | S | 1/2012 | Lee |
| 8,099,825 | B2 | 1/2012 | Zahuranec et al. |
| D660,532 | S | 5/2012 | Kim |
| D670,878 | S | 11/2012 | Lee |
| D672,104 | S | 12/2012 | Steele |
| 8,387,206 | B2 | 3/2013 | Arthey et al. |
| D684,326 | S | 6/2013 | Okabe et al. |
| D726,980 | S | 4/2015 | Kim et al. |
| D730,001 | S | 5/2015 | Yun et al. |
| D735,426 | S | 7/2015 | Yun et al. |
| D740,503 | S | 10/2015 | Tyler |
| 2002/0042331 | A1 | 4/2002 | Fortner et al. |
| 2002/0073504 | A1 | 6/2002 | Hall et al. |
| 2002/0194694 | A1 | 12/2002 | Waldron et al. |
| 2002/0194696 | A1 | 12/2002 | Sergyeyenko et al. |
| 2004/0040102 | A1 | 3/2004 | Field et al. |
| 2004/0111821 | A1 | 6/2004 | Lenkiewicz et al. |
| 2004/0221407 | A1 | 11/2004 | Field et al. |
| 2004/0233063 | A1 | 11/2004 | Sorbo et al. |
| 2005/0000053 | A1 | 1/2005 | Kasper et al. |
| 2005/0022333 | A1 | 2/2005 | McDowell et al. |
| 2005/0050671 | A1 | 3/2005 | Brennan et al. |
| 2005/0050672 | A1 | 3/2005 | Lenkiewicz et al. |
| 2005/0194235 | A1 | 9/2005 | Wilmo et al. |
| 2005/0194236 | A1 | 9/2005 | Wilmo et al. |
| 2005/0217062 | A1 | 10/2005 | Field et al. |
| 2006/0032519 | A1 | 2/2006 | Field et al. |
| 2006/0207052 | A1 | 9/2006 | Tran |
| 2006/0236494 | A1 | 10/2006 | Nelson et al. |
| 2006/0288518 | A1 | 12/2006 | Lenkiwicz et al. |
| 2007/0056132 | A1 | 3/2007 | Yamaguchi et al. |
| 2007/0067945 | A1 | 3/2007 | Kasper et al. |
| 2007/0089260 | A1 | 4/2007 | Shinler et al. |
| 2007/0089261 | A1 | 4/2007 | Hansen et al. |
| 2007/0094835 | A1 | 5/2007 | Huffman |
| 2007/0130721 | A1 | 6/2007 | Huffman et al. |
| 2007/0180645 | A1 | 8/2007 | Field et al. |
| 2007/0186367 | A1 | 8/2007 | Field et al. |
| 2007/0186368 | A1 | 8/2007 | Field et al. |
| 2007/0186369 | A1 | 8/2007 | Field et al. |
| 2007/0186954 | A1 | 8/2007 | Field et al. |
| 2007/0186957 | A1 | 8/2007 | Field et al. |
| 2007/0186958 | A1 | 8/2007 | Field et al. |
| 2007/0187261 | A1 | 8/2007 | Field et al. |
| 2007/0187262 | A1 | 8/2007 | Field et al. |
| 2007/0187263 | A1 | 8/2007 | Field et al. |
| 2007/0209138 | A1 | 9/2007 | Tran et al. |
| 2007/0224877 | A1 | 9/2007 | Tran |
| 2008/0072395 | A1 | 3/2008 | McDowell |
| 2008/0092325 | A1 | 4/2008 | Vander Baan |
| 2008/0178419 | A1 | 7/2008 | Courtney et al. |
| 2008/0196193 | A1 | 8/2008 | Huffman et al. |
| 2008/0210572 | A1 | 9/2008 | Field |
| 2008/0216273 | A1 | 9/2008 | Medema et al. |
| 2008/0216278 | A1 | 9/2008 | Krebs et al. |
| 2009/0089969 | A1 | 4/2009 | Lee et al. |
| 2009/0126144 | A1 | 5/2009 | Kasper et al. |
| 2009/0144928 | A1 | 6/2009 | Yoo |
| 2009/0191390 | A1 | 7/2009 | Saji et al. |
| 2010/0083460 | A1 | 4/2010 | Beskow et al. |
| 2011/0010889 | A1 | 1/2011 | Arthey et al. |
| 2011/0191968 | A1 | 8/2011 | Moes et al. |
| 2012/0204367 | A1 | 8/2012 | Stegens |

(56) References Cited

U.S. PATENT DOCUMENTS

| | | | |
|---|---|---|---|
| 2012/0273123 | A1 | 11/2012 | Sinykin |
| 2015/0238061 | A1 | 8/2015 | Adams et al. |

FOREIGN PATENT DOCUMENTS

| | | | |
|---|---|---|---|
| EP | 1479336 | A2 | 11/2004 |
| EP | 1508292 | A2 | 2/2005 |
| GB | 842668 | | 7/1960 |
| JP | 6-70869 | | 3/1994 |
| JP | 6-70870 | A | 3/1994 |
| JP | 11-206643 | A | 8/1999 |
| JP | 2000-93365 | A | 4/2000 |
| JP | 2005-66061 | A | 3/2005 |
| WO | 0026456 | A1 | 5/2000 |
| WO | 2008074014 | A2 | 6/2008 |
| WO | 2009094430 | A1 | 7/2009 |
| WO | 2009/149722 | A1 | 12/2009 |
| WO | 2015015166 | A1 | 2/2015 |

OTHER PUBLICATIONS

Acker, Karen S.; Notice of Allowance and Fee(s) Due, issued in related U.S. Appl. No. 29/506,773, filed Oct. 20, 2014; Inventor: Kenneth C. Rutter; Title: Textile with Pattern; 36 pages in its entirety.

McInroy, Ruth; Non-final Office Action issued in related U.S. Appl. No. 29/506,778; dated Mar. 28, 2016; 9 pages.

Young, Lee W.; International Search Report and Written Opinion of the International Searching Authority, issued in International Application No. PCT/US2015/016756; dated as mailed on May 29, 2015; 10 pages.

Copenheaver, Blaine R.; International Search Report and Written Opinion of the International Searching Authority, issued in International Application No. PCT/US2015/013366; dated as mailed on May 6, 2015; 9 pages.

Copenheaver, Blaine R.; International Search Report and Written Opinion of the International Searching Authority, issued in International Application No. PCT/US2015/013366; dated as mailed on May 6, 2015; 8 pages.

SURFACE-TREATMENT APPARATUS AND HEAD UNIT

TECHNICAL FIELD

This application generally relates to a surface-treatment apparatus having a head unit that facilitates treatment of a surface with a fluid.

BACKGROUND

Conventional surface-treatment apparatuses have a head unit that dispenses fluid onto a surface and applies the fluid with a rotary head.

SUMMARY

A head unit for a surface-treatment apparatus is provided and comprises a housing, a fluid inlet and a dispensation unit. The fluid inlet is for receiving fluid from a fluid reservoir. The dispensation unit defines a dispensation chamber and an input port in fluid communication with each of the dispensation chamber and the fluid inlet. The dispensation unit comprises at least one wall that defines an elongated dispensation outlet for the fluid. Said at least one baffle extends from said at least one wall at a height above said at least one wall such that the baffle extends into the dispensation chamber. Said at least one baffle is located adjacent to the input port and extends away from the input port.

A head unit for a surface-treatment apparatus is provided and comprises a housing a rotary member and a collection container. The housing comprises a fluid inlet, a dispensation unit, and at least one baffle. The fluid inlet is for receiving fluid from a fluid reservoir. The dispensation unit defines a dispensation chamber in fluid communication with the fluid inlet. The dispensation unit defines an elongated dispensation outlet for the fluid. Said at least one baffle is disposed within and extends into the dispensation chamber. Said at least one baffle is configured to direct the flow of fluid through the dispensation unit and out of the elongated dispensation outlet. The rotary member is rotatably coupled with the housing and is rotatable about a rotational axis. The rotary member is positioned adjacent the dispensation unit and is configured to collect the fluid that is dispensed from the elongated dispensation outlet onto a surface. The collection container is associated with the housing and is configured to collect the fluid from the rotary member.

A surface-treatment apparatus comprises a body, a motor, a fluid reservoir, and a head unit. The motor is coupled with the body. The fluid reservoir is coupled with the body and is configured to store fluid therein. The head unit is operably coupled with the motor and comprises a housing, a rotary member, and a collection container. The housing comprises a fluid inlet, a dispensation unit, and at least one baffle. A fluid inlet for receiving fluid from the fluid reservoir. The dispensation unit defines a dispensation chamber in fluid communication with the fluid inlet. The dispensation unit defines an elongated dispensation outlet for the fluid. Said at least one baffle is disposed within and extends into the dispensation unit. Said at least one baffle is configured to direct the flow of fluid through the dispensation unit and out of the elongated dispensation outlet. The rotary member is rotatably coupled with the housing and is operably coupled with the motor. The rotary member is rotatable about a rotational axis and is positioned adjacent the elongated dispensation outlet. The rotary member is further configured to collect the fluid dispensed from the elongated dispensation outlet. The collection container is associated with the housing and is configured to collect the dispensed fluid from the rotary member.

BRIEF DESCRIPTION OF THE DRAWINGS

Certain embodiments will be better understood from the following description taken in conjunction with the accompanying drawings in which.

DETAILED DESCRIPTION

Figure 1:
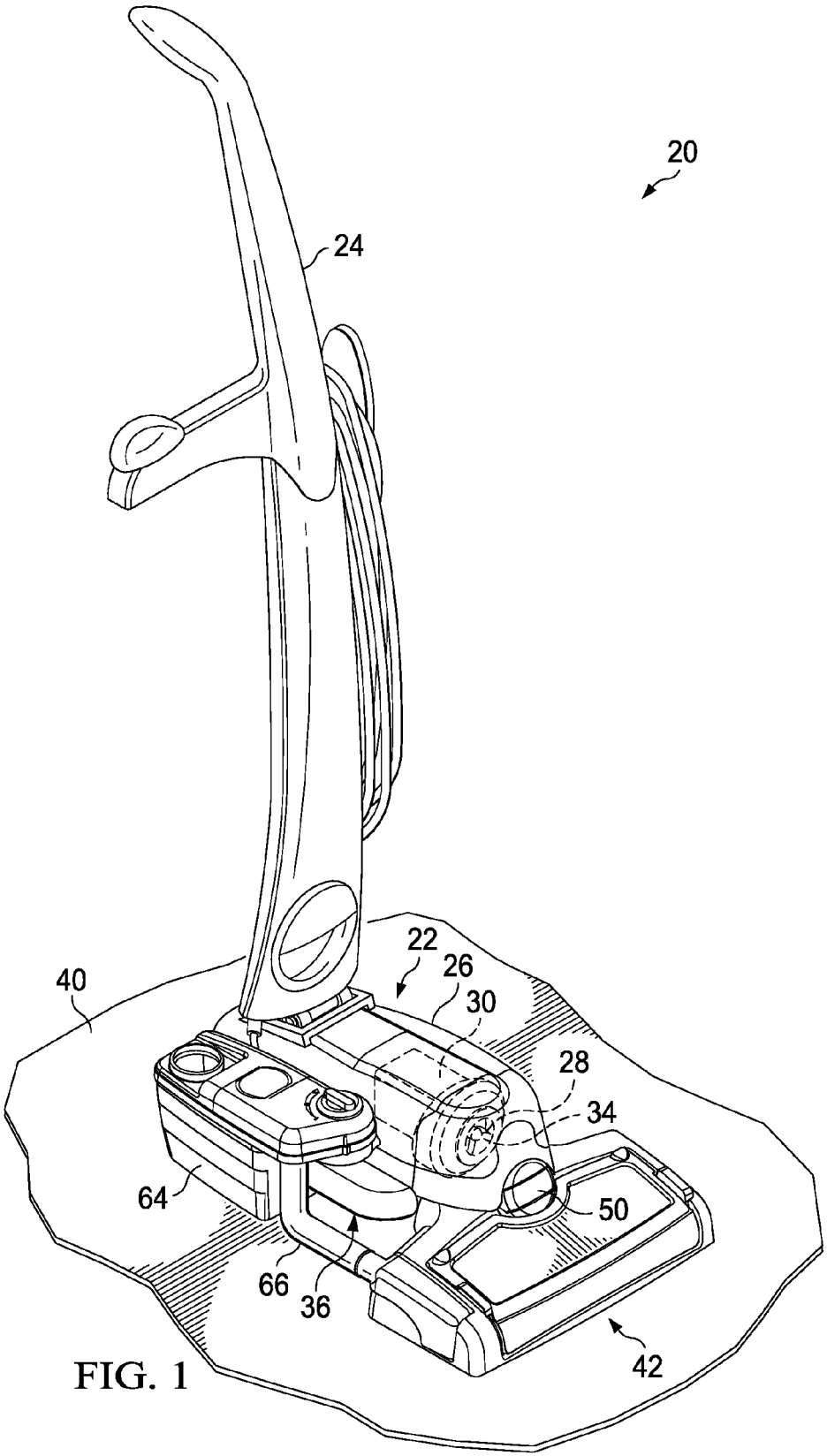
FIG. 1 is a front perspective view depicting a surface-treatment apparatus that includes a head unit, in accordance with one embodiment.

Certain embodiments are described herein in connection with the views and examples of FIGS. 1-11, wherein like numbers indicate the same or corresponding elements throughout the views. FIG. 1 illustrates a surface-treatment apparatus 20. Although the surface-treatment apparatus 20 is shown to be a vacuum cleaner, any of a variety of other suitable alternative surface-treatment apparatuses can be provided. In one embodiment, the surface-treatment apparatus 20 can include a body 22 and a handle 24 extending from the body 22. The body 22 can further include a drive housing 26 which can house a fan 28 and a motor 30. The motor 30 can power the fan 28 to facilitate a flow of air into an inlet 34 and out through an exhaust outlet 36 of the body 22. The motor 30 can be selectively operable with a switch (not shown) mounted on the handle 24 or any of a variety of other suitable locations on the surface-treatment apparatus 20. One or more wheels (not shown) can be rotatably coupled with the body 22 to enable wheeled movement of the surface-treatment apparatus 20 across a surface 40.

Figure 2:
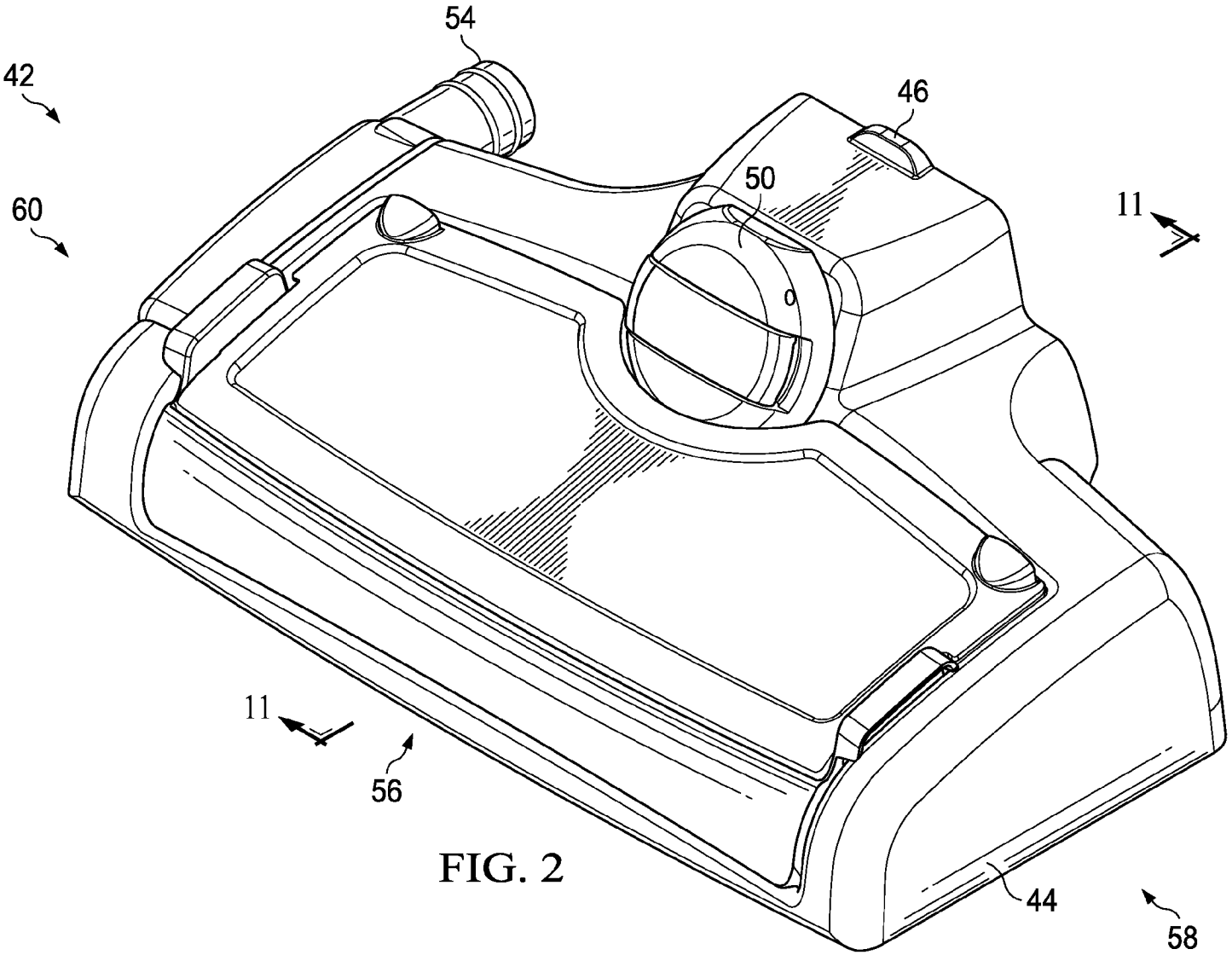
FIG. 2 is a front perspective view depicting the head unit of FIG. 1.
Figure 3:
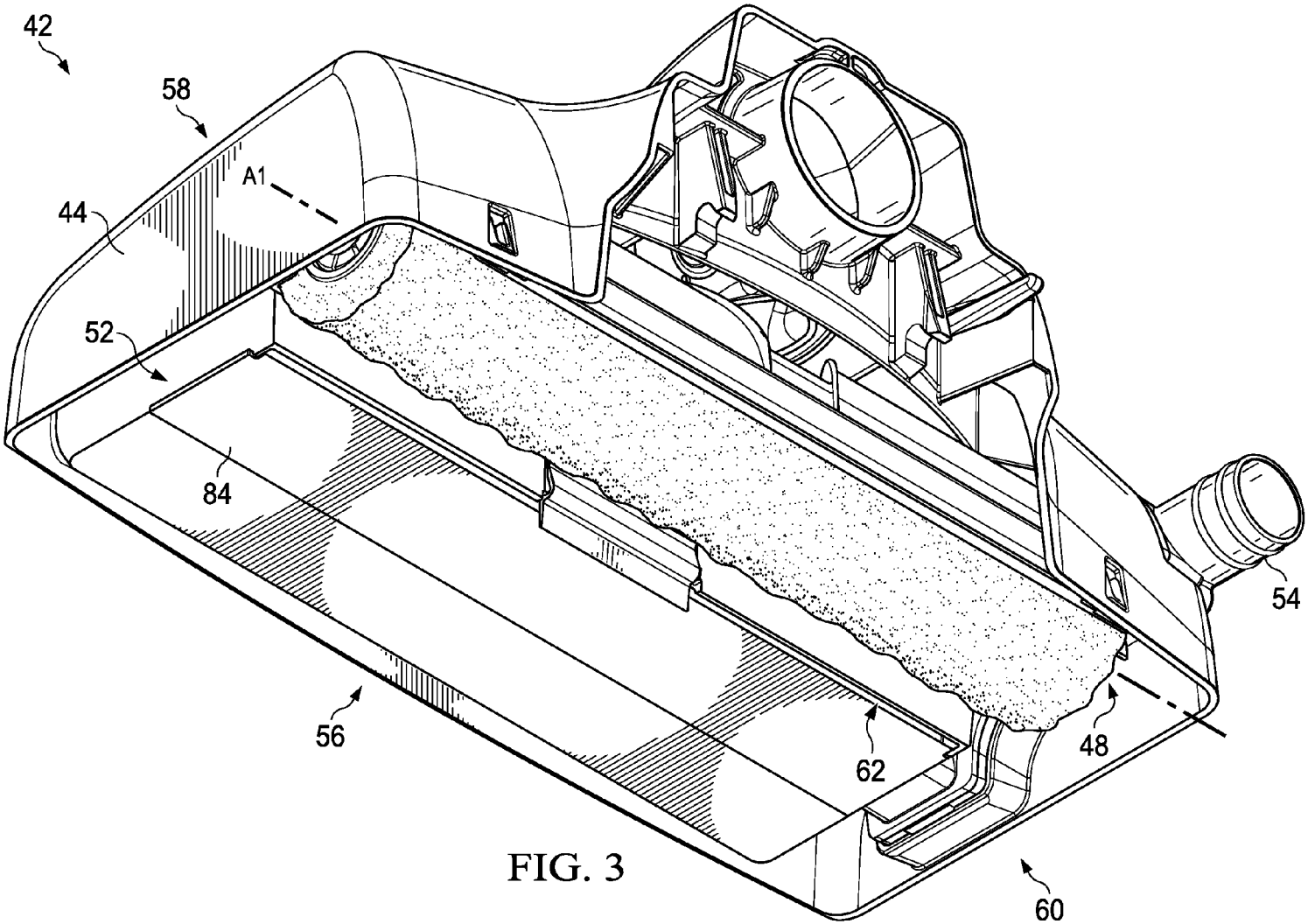
FIG. 3 is a rear perspective view depicting the head unit of FIG. 1.

As illustrated in FIGS. 1-3, the surface-treatment apparatus 20 can include a head unit 42 that facilitates treatment of the surface 40 with a fluid. The head unit 42 can include a housing 44. The head unit 42 can be releasably coupled with the body 22 such that the head unit 42 is selectively removable from the body 22. The head unit 42 can be removed to facilitate cleaning/maintenance of the body 22 and/or the head unit 42. Removal of the head unit 42 from the body 22 can additionally or alternatively facilitate interchanging of the head unit 42 with a different head unit (e.g., a vacuum cleaner type head unit). In one embodiment, the surface-treatment apparatus 20 can include a latching mechanism (not shown) that interacts with a tang 46 (FIG. 2) to facilitate releasable securement of the housing 44 of the head unit 42 onto the body 22.

As illustrated in FIG. 3, the head unit 42 can include a rotary member 48 that is rotatably coupled with the housing 44 and rotatable about a rotational axis Al. In one embodiment, the rotary member 48 can be journalled with respect to the housing 44 by bearings (not shown). The rotary member 48 can be operably coupled to the motor 30 driven by a belt (not shown) that is routed underneath the rotary member 48 and along a drive shaft (not shown) of the motor 30. In one embodiment, the head unit 42 can include a rotatable cap 50 (FIGS. 1 and 2) having a belt installation tool (e.g., a hook) (not shown) that is mounted thereto. In such an embodiment, rotation of the rotatable cap 50 can facilitate selective installation or removal of the belt from the drive shaft to allow for installation or removal, respectively, of the head unit 42 from the body 22. In one embodiment, the rotational axis Al of the rotary member 48 can be substantially horizontal. It will be appreciated that an axis described herein as being oriented substantially horizontal, should be understood to mean that the rotational axis resides in a plane that is substantially parallel with another plane within which the rotational axis of the motor (e.g., 30) resides.

In one embodiment, the rotary member 48 can be selectively removed from the housing 44 to allow for effective maintenance and/or replacement of the rotary member 48. It is to be appreciated that in some embodiments, the rotary member 48 can be removed and/or installed without requiring specialized tools, a high level of user skill, or extensive disassembly of the surface-treatment apparatus 20.

As illustrated in FIG. 3, the head unit 42 can include a dispensation unit 52 that is in fluid communication with a fluid inlet 54. The dispensation unit 52 can be disposed forwardly of the rotary member 48 (e.g., between the rotary member 48 and a front end 56 of the housing 44). The dispensation unit 52 can extend between left and right sides 58, 60 of the housing 44 and can define an elongated dispensation outlet 62.

Referring again to FIG. 1, the surface-treatment apparatus 20 can include a fluid reservoir 64 coupled with the body 22 and configured to store fluid therein. The fluid reservoir 64 can be in fluid communication with the fluid inlet 54 via a conduit 66. Fluid from the fluid reservoir 64 can be dispensed through the conduit 66, through the fluid inlet 54 and to the dispensation unit 52 for dispensation from the elongated dispensation outlet 62, and onto the surface 40. It is to be appreciated that any of a variety of suitable fluids can be provided in the fluid reservoir for application to the surface 40, such as, for example, water, cleaning solutions (e.g., soaps or disinfectants), perfumes, antistatic agents, polishing compounds, buffing compounds, and coatings (e.g., paint or varnish).

Figure 4:
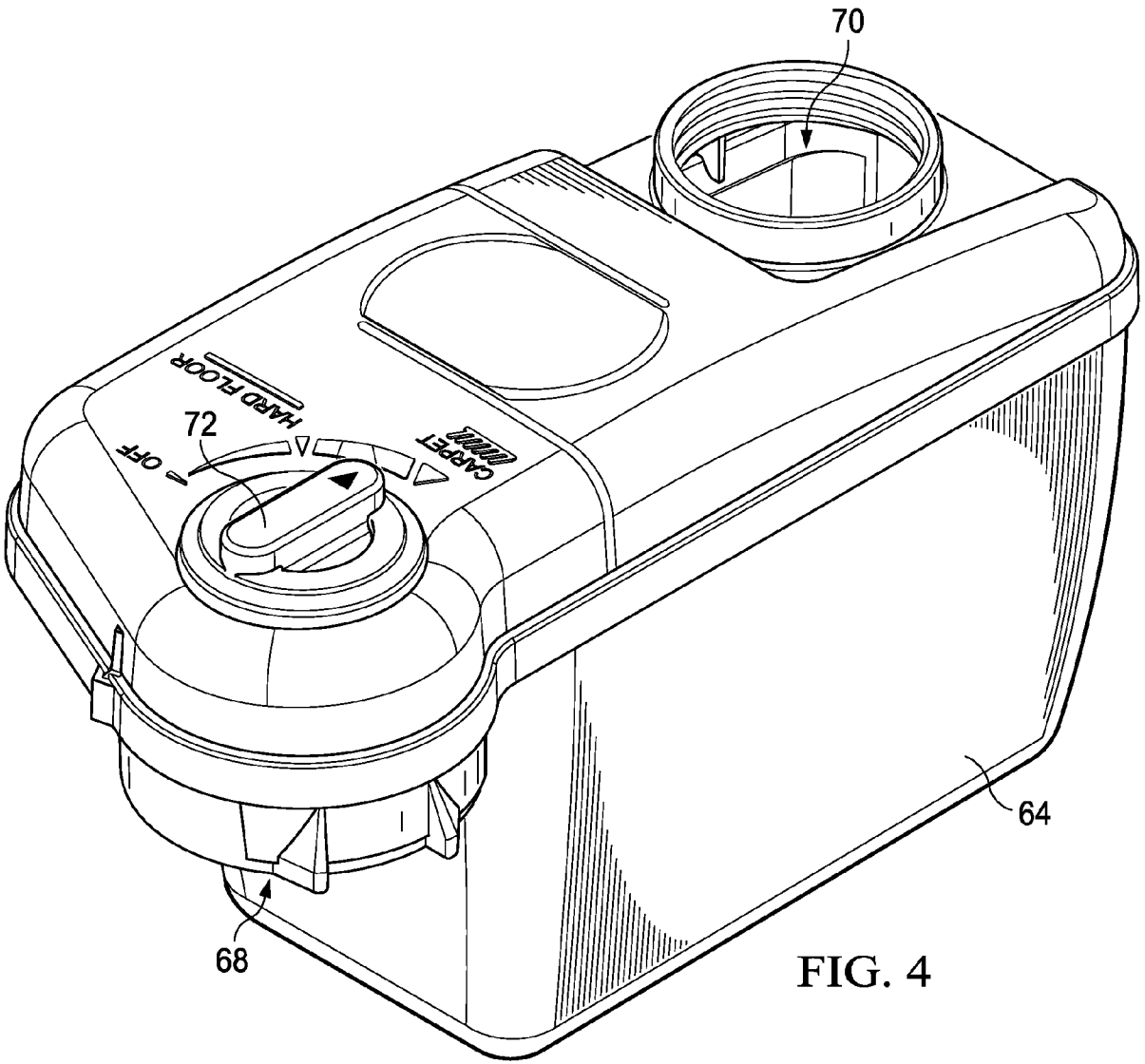
FIG. 4 is a front perspective view depicting a fluid reservoir of the surface-treatment apparatus of FIG. 1.

Referring now to FIGS. 1 and 4, the fluid reservoir 64 can include a pressurization port 68 that is in fluid communication with the exhaust outlet 36. When the motor 30 is operating, exhaust air from the motor 30 can pressurize the fluid reservoir 64 to facilitate dispensation of fluid from the fluid reservoir 64 to the elongated dispensation outlet 62. In one embodiment, as illustrated in FIG. 4, the reservoir 64 can include a fill port 70 which can facilitate filling of the fluid reservoir 64. The fill port 70 can be selectively covered with a removable cap (not shown). In an alternative embodiment, a fluid reservoir might be self-contained and thus devoid of a fill port.

In one embodiment, the fluid reservoir 64 can include a suds generator (not shown). The suds generator can be configured to combine the fluid stored within the fluid reservoir 64 with exhaust air from the exhaust outlet 36 such that suds are formed in the fluid and then dispensed through the conduit 66, through the fluid inlet 54, and to the dispensation unit 52 for dispensation from the elongated dispensation outlet 62 and onto the surface 40. An example suds generator is disclosed in U.S. Pat. No. 3,370,315 which is hereby incorporated by reference herein in its entirety.

Referring now to FIG. 4, the fluid reservoir 64 can include a selector 72 that is associated with the suds generator and facilitates variable selection of different settings for the suds generator. In one embodiment, the selector 72 can be a three-position switch having an OFF setting, a HARD FLOOR setting, and a CARPET setting. When the selector 72 is set to OFF, the fluid dispensed from the elongated dispensation outlet 62 is substantially devoid of suds. When the selector 72 is set to HARD FLOOR, the fluid dispensed from the elongated dispensation outlet 62 has an amount of suds sufficient to treat a hard floor (e.g., greater than the OFF setting but less than the CARPET setting). When the selector 72 is set to CARPET, the fluid dispensed from the elongated dispensation outlet 62 has an amount of suds sufficient for carpet (e.g., greater than the HARD FLOOR setting). In an alternative embodiment, the suds generator can be separate from the fluid reservoir 64. In yet another alternative embodiment, the fluid reservoir 64 can be substantially devoid of a suds generator.

Figure 5:
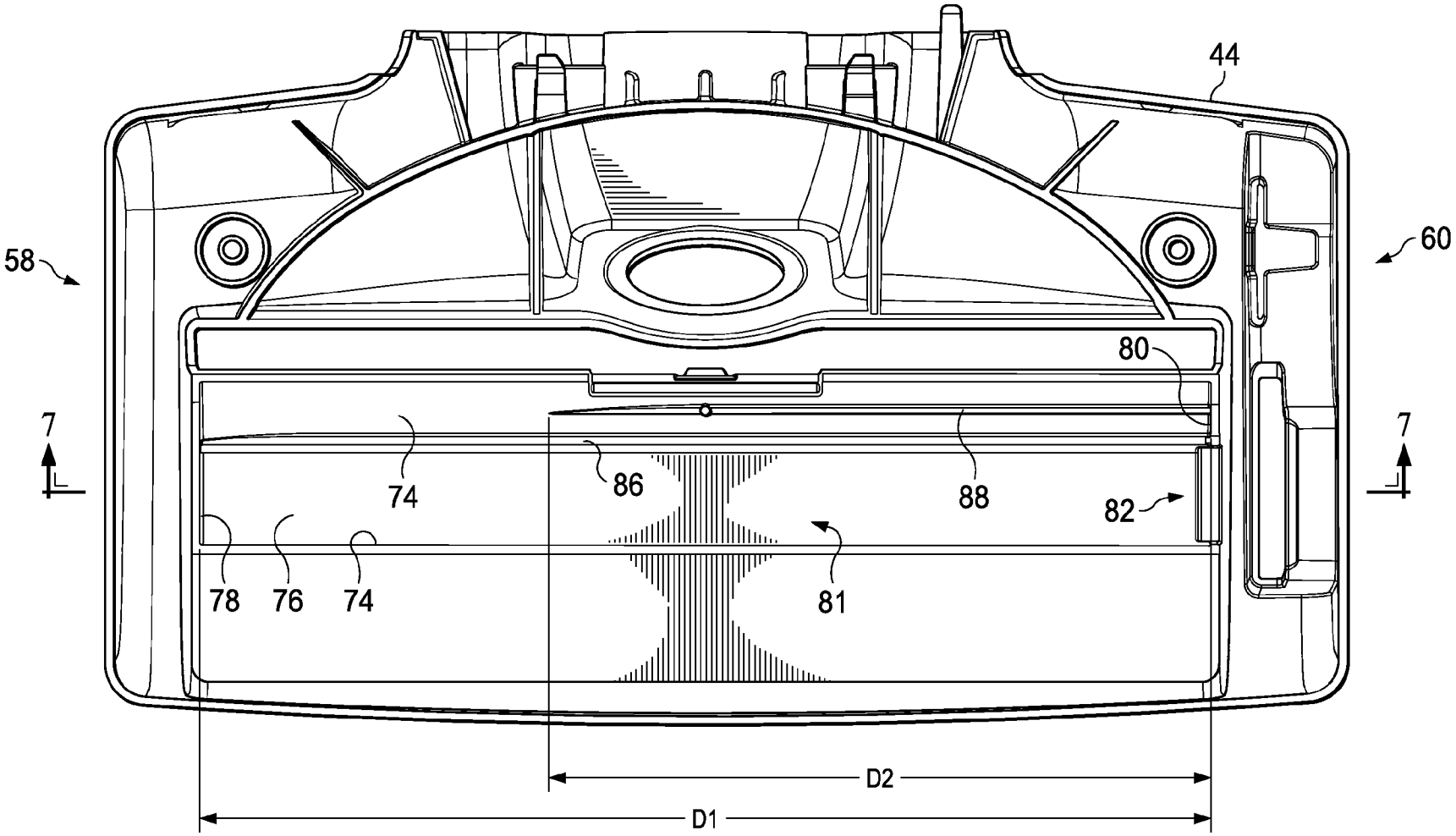
FIG. 5 is a lower plan view depicting the head unit with certain components removed for clarity of illustration.

Referring now to FIG. 5, the dispensation unit 52 can include a pair of sidewalls 74, a top wall 76, and left and right end walls 78, 80. Each of the top wall 76 and the left and right end walls 78, 80 can extend between the sidewalls 74 and can cooperate with the sidewalls 74 to define a dispensation chamber 81. The left and right end walls 78, 80 can be disposed at the respective left and right sides 58, 60 of the housing 44. In one embodiment, the right end wall 80 can cooperate with the sidewalls 74 to define an input port 82 in fluid communication with the inlet 34 for providing ingress of fluid into the dispensation unit 52. With the input port 82 disposed at the right side 60 of the housing 44, the inlet 34 can also be disposed at the right side 58 of the housing 44 which can be a more effective and efficient location for the inlet 34 than certain conventional top-mounted inlet arrangements such as the arrangement disclosed in U.S. Pat. No. 4,573,235, which is hereby incorporated herein by reference in its entirety. In an alternative embodiment, the inlet 34 can be disposed at the left side 58 of the housing 44. In such an embodiment, the left end wall 78 can cooperate with the sidewalls 74 to define an input port disposed at the left side 58 for the inlet 34.

Figure 6:
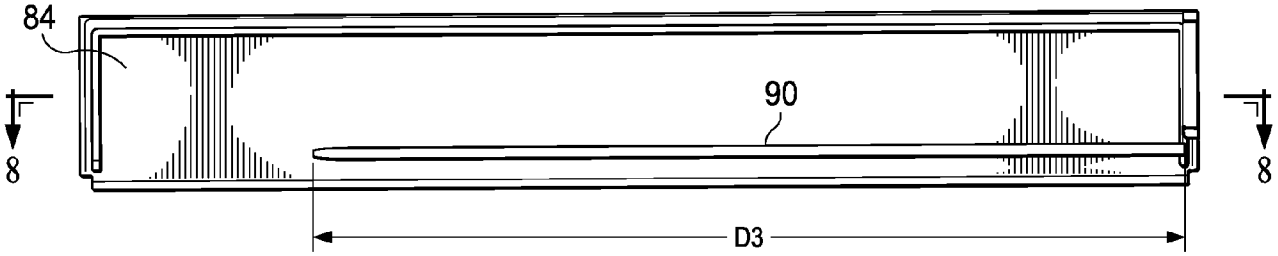
FIG. 6 is a lower plan view depicting a cover wall of the head unit of FIG. 1.
Figure 7:
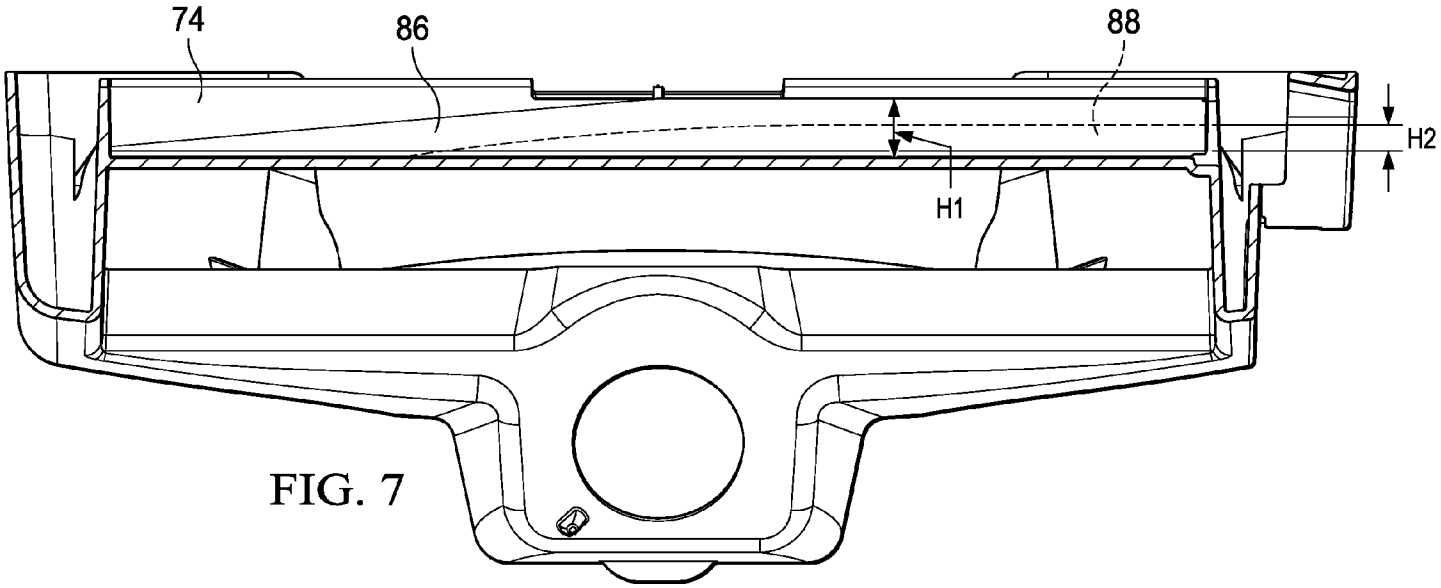
FIG. 7 is a cross-sectional view taken along the line 7-7 in FIG. 5.

The dispensation unit 52 can additionally include a cover wall 84, as illustrated in FIG. 6. The cover wall 84 can extend between the sidewalls 74 and can overlie and be spaced apart from the top wall 76. As illustrated in FIG. 3, the cover wall 84 can cooperate with one of the sidewalls 74 to define the elongated dispensation outlet 62. In one embodiment, the cover wall 84 can be hingedly coupled with one of the sidewalls 74. In another embodiment, the cover wall 84 can be rigidly coupled with at least one of the sidewall 74 and/or end walls 78, 80 (e.g., via plastic welding). In yet another embodiment, the cover wall 84 can be coupled together with the sidewalls 74 and the end walls 78, 80 such that the sidewalls 74, end walls 78, 80 and cover wall 84 are formed together as a one piece construction.

Referring again to FIGS. 5 and 6, the housing 44 can include a first baffle 86 that extends from the top wall 76 (FIG. 5) of the dispensation unit 52, a second baffle 88 that extends from one of the sidewalls 74 of the dispensation unit 52, and a third baffle 90 that extends from the cover wall 84 of the dispensation unit 52. The first baffle 86 can be disposed between the sidewalls 74, and the second baffle 88 can be disposed adjacent to the first baffle 86, between the first baffle 86 and one of the sidewalls 74.

Figure 11:
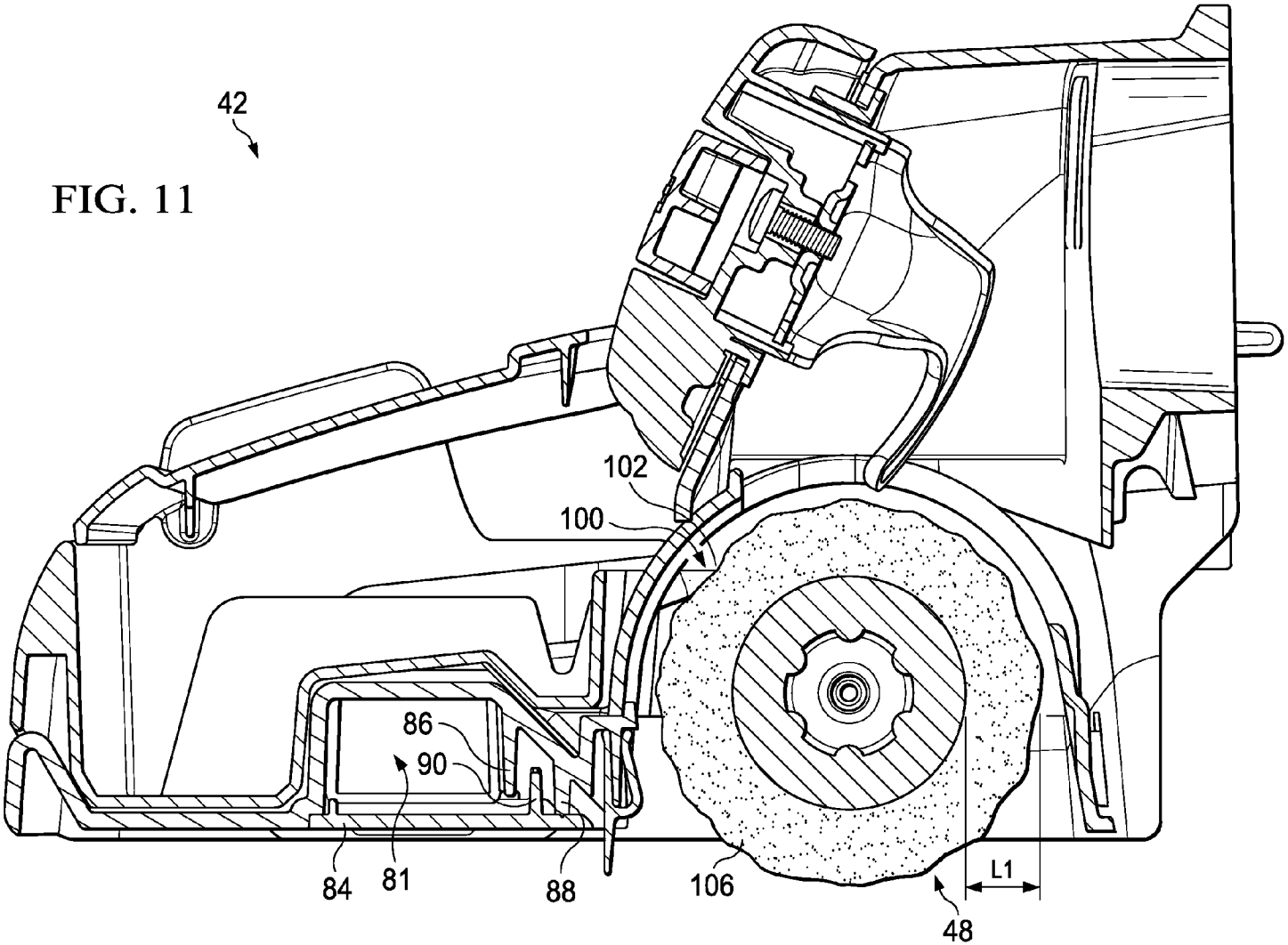
FIG. 11 is a cross-sectional view taken along the line 11-11 in FIG. 2.

Each of the first, second, and third baffles 86, 88, 90 can have respective first, second, and third lengths D1, D2, D3. The first length D1 can be greater than the second and third lengths D2, D3. The third length D3 can be less than the first length D1 but greater than the second length D2. The second length D2 can be less than each of the first and third lengths D1, D3. In one embodiment, with the cover wall 84 installed over the dispensation chamber 81, the first, second, and third baffles 86, 88, 90 can be located adjacent to the input port 82 and can extend away from the input port 82 in a direction that is substantially parallel to the rotational axis Al of the rotary member 48. As illustrated in FIG. 11, with the cover wall 84 installed, the third baffle 90 can be interposed between the first and second baffles 86, 88.

Figure 8:
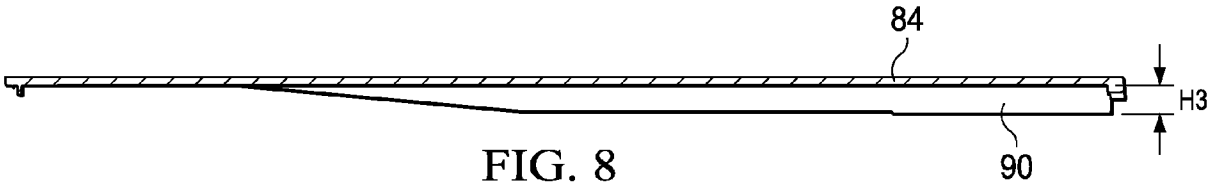
FIG. 8 is a cross-sectional view taken along the line 8-8 in FIG. 6.

Each of the first, second, and third baffles 86, 88, 90 can be tapered such that at least a portion of their respective heights decreases as they extend away from the input port 82. For example, referring now to FIG. 7, the first baffle 86 is shown to have a maximum height H1 relative to the top wall 76 at the input port 82. As the first baffle 86 extends away from the input port 82, the height of the first baffle 86 can decrease relative to the maximum height H1. Still referring to FIG. 7, the second baffle 88 is shown to have a maximum height H2 relative to one of the sidewalls 74 at the input port 82. As the second baffle 88 extends away from the input port 82, the height of the second baffle 88 can decrease relative to the maximum height H2. Referring now to FIG. 8, the third baffle 90 is shown to have a maximum height H3 relative to the cover wall 84. As the third baffle 90 extends away from the input port 82 (not shown in FIG. 8), the height of the third baffle 90 can decrease relative to the maximum height H3.

When fluid from the fluid inlet 54 is introduced through the input port 82 and into the dispensation chamber 81 of the dispensation unit 52, the fluid can interact with the first, second, and third baffles 86, 88, 90 in such a manner to encourage consistent and uniform dispensation of fluid from the elongated dispensation outlet 62. For example, when the fluid flows from the input port 82 towards the left end wall 78, the tapered profiles of each of the first, second, and third baffles 86, 88, 90 can provide a diminishing obstacle for the fluid as it flows towards the left end wall 78 which can substantially equalize the fluidic pressure across the elongated dispensation outlet 62 thereby providing consistent dispensation of the fluid from along the elongated dispensation outlet 62. The dispensation unit 52 can accordingly be less susceptible to increased amounts of fluid dispensed at the input port 82 than some conventional arrangements. It is to be appreciated that one or more baffles can be provided in any of a variety of suitable arrangements within a dispensation unit to encourage consistent and uniform dispensation of fluid from a dispensation outlet of a surface-treatment apparatus. In particular, a baffle can be of any suitable length, width, or depth and can be graduated, either gradually or in steps, to achieve any of a variety of tapered configurations. Furthermore, a baffle can also be disposed on a single wall or on a combination of walls at any angle with respect to the wall. If more than one baffle is provided, the baffles can be dissimilar or substantially uniform with respect to dimensions, graduation, placement, and angle positioning and can be any dimension, graduation, placement and angle position that is suitable to direct the flow of the fluid in a manner that encourages consistent and uniform dispensation of fluid.

Figure 9:
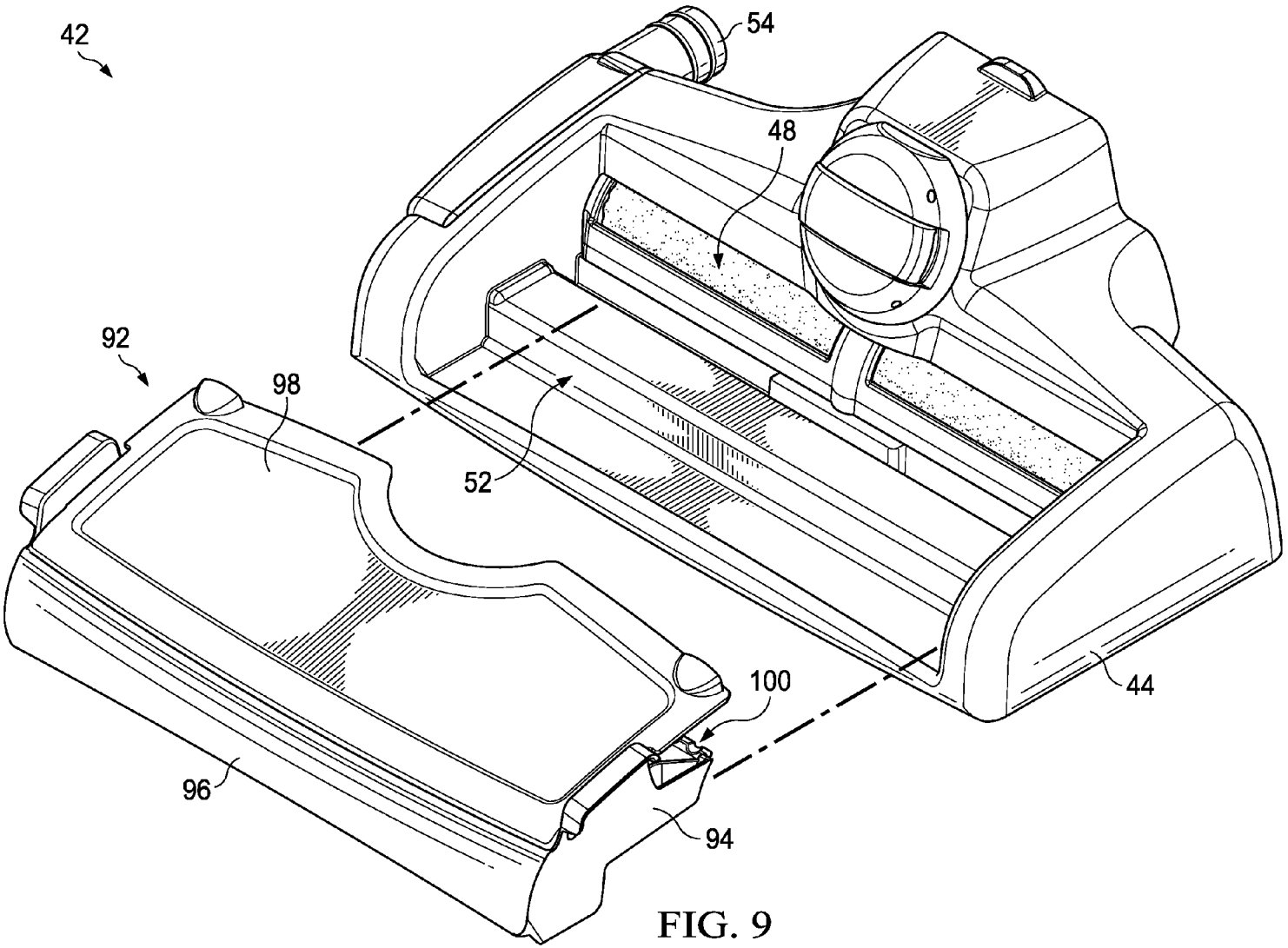
FIG. 9 is a front perspective view depicting the head unit of FIG. 1, wherein a collection container is shown removed from a housing of the head unit.

Referring now to FIGS. 1-3, 9 and 10, the head unit 42 can include a collection container 92 associated with the housing 44 and configured to collect fluid from the rotary member 48. As illustrated in FIG. 9, the collection container 92 can include a housing 94 that defines a collection reservoir 96. A lid 98 can be hingedly coupled with the housing 94 and can selectively cover the collection reservoir 96. The collection container 92 can include a wiper member 100 that is disposed at a rear end of the collection container 92 adjacent to the collection reservoir 96.

Figure 10:
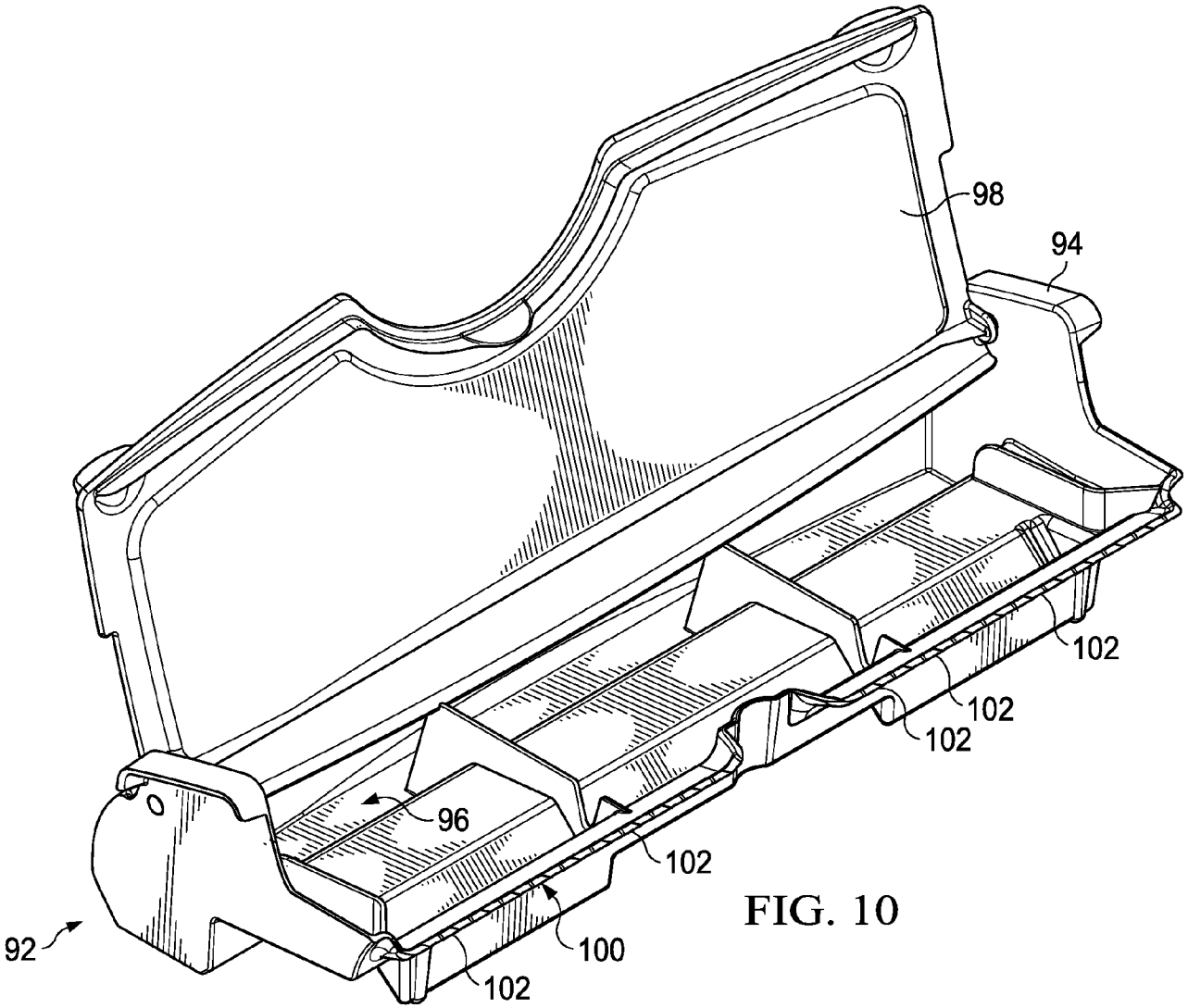
FIG. 10 is a front perspective view depicting the collection container of FIG. 9 with a lid shown in an opened position.

In one embodiment, as illustrated in FIG. 10, the collection container 92 can be selectively removable from the housing 44 of the head unit 42. In other embodiments, the collection container 92 can be integrated into the housing 44 of the head unit 42 such that the respective housings 44, 94 of the head unit 42 and the collection container 92 are provided together in a one-piece construction.

As illustrated in FIG. 11, with the collection container 92 installed on the housing 44 of the head unit 42, the wiper member 100 can extend into the rotary member 48 to facilitate removal of fluid from the rotary member 48. When the rotary member 48 is rotated in the counter-clockwise direction (e.g., when viewing the rotary member 48 from the left side 58 of the housing 44), the wiper member 100 can extend far enough into the rotary member 48 such that fluid from the rotary member 48 can be removed (e.g., scraped) onto the wiper member 100. The fluid can flow over the wiper member 100 and can collect in the collection reservoir 96. In one embodiment, as illustrated in FIG. 10, the wiper member 100 can be a scalloped doctor blade that comprises a plurality of teeth 102. In other embodiments, a wiper member 100 can be any of a variety of suitable alternative arrangements for removing fluid from a rotary member 48. For example, the wiper member 100 can have a straight edge (e.g. without a plurality of teeth 102), a blunt, rolled edge, a beveled edge, or a combination of edge configurations, Still referring to FIG. 11, the rotary member 48 is shown to include an outer cover 104 having a nap material 106 extending therefrom at a length L1. During operation of the surface-treatment apparatus 20, the rotary member 48 can be rotated by the motor 30. When fluid is dispensed onto the surface 40 from the elongated dispensation outlet 62 and the surface-treatment apparatus 20 is moved forwardly, the rotary member 48 can apply downward force to the surface 40 and the nap material 106 can interact with the fluid to facilitate application of the fluid onto the surface 40. Excess fluid can be retrieved by the rotary member 48 and the wiper member 100 can interact with the nap material 106 to remove the excess fluid from the nap material 106. The centrifugal force of the rotary member 48 can force the removed fluid over the wiper member 100 and into the collection reservoir 96. Once the collection reservoir 96 is full, the collection container 92 can be removed from the housing 44 and emptied. In embodiments where the collection container 92 is integral with the housing 44, the entire head unit 42 can be removed from the body 22 to facilitate emptying of the collection reservoir 96.

It is to be appreciated that the rotary member 48 can be interchanged with other rotary members having different nap lengths, materials, and/or absorption characteristics. The rotary member 48 can be selected depending upon the type of surface (e.g., 40), the type of fluid being applied to the surface, and/or intended surface-treatment. For example, to shampoo carpets, a rotary member having a soft (e.g., cotton) long nap suitable to deposit and work fluid into the carpet and subsequently absorb the fluid can be selected. To clean hard floors, a rotary member having a dense, short nap can be selected. To buff or polish a surface (e.g., granite), a rotary member having a nap that permits fluid to remain substantially in contact with the surface (e.g., 40) can be selected for polishing the surface (e.g., granite). To burnish a surface, a rotary member having a rough nap able to withstand higher temperatures associated with the heating and melting of wax during the burnishing process can be selected. Additionally, to effect an abbreviated cleaning, of for example a carpet, a rotary member having bristles can be selected to whisk dirt out of the carpet and provide a cursory shampoo.

The length (e.g., L1) of the nap material (e.g., 104) can also affect the extent to which the fluid is removed from the rotary member 48. For example, the wiper member 100 can extend further into a longer nap length than a shorter nap length such that more fluid is removed from the rotary member 48 with the longer nap or bristle length. The nap length can thus be additionally or alternatively be selected to achieve certain removal characteristics based upon the type of surface (e.g., 40) and/or the type of fluid being applied to the surface. For example, a rotary member 48 having a nap length that is short enough to avoid contact with the wiper member 100 can be selected for applying a coating (e.g., a sealer) to a hard floor.

In another embodiment, the wiper member 100 can be movable between a retracted position (not shown) and a contacting position (not shown) to facilitate selective removal of fluid from the rotary member 48. When the wiper member 100 is in the retracted position, the wiper member 100 can be spaced from the rotary member 48. When the wiper member 100 is in the contacting position, the wiper member 100 can extend into the rotary member 48. The wiper member 100 can thus be positioned between the retracted and contacting positions to achieve a desired removal characteristic for the rotary member 48.

It is to be appreciated that a rotary member can having an outer cover substantially devoid of a nap material and formed of a variety of suitable alternative materials, such as foam (e.g., for paint) or silicon (e.g., for pushing fluid). Additional embodiments of suitable rotary members are disclosed in in U.S. patent application Ser. No. 14/186,943, which is hereby incorporated by reference herein in its entirety.

It is to be appreciated that although the head unit 42 is described as comprising each of a rotary member (e.g., 48) and a dispensation unit (e.g., 52), in an alternative embodiment, a head unit might be devoid of a dispensation unit for applying a fluid to a surface. In such an embodiment, the fluid can be dispensed onto the surface manually and without requiring a fluid reservoir (e.g., 64) and applied to the surface by a rotary member (e.g., 48). In another alternative embodiment, a head unit might be devoid of a rotary member. In such an embodiment, the fluid can be dispensed onto the surface from a dispensation unit and manually applied/removed to/from the surface (e.g., with a mop).

The foregoing description of embodiments and examples have been presented for purposes of illustration and description. They are not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto.

What is claimed is:

1. A head unit for a surface-treatment apparatus, the head unit comprising:

a housing comprising:

a fluid inlet for receiving fluid from a fluid reservoir;

a dispensation unit defining a dispensation chamber and an input port in fluid communication with each of the dispensation chamber and the fluid inlet, the dispensation unit comprising at least one wall that defines an elongated dispensation outlet for the fluid; and at least one baffle extending from said at least one wall at a height above said at least one wall such that the baffle extends into the dispensation chamber, said at least one baffle being located adjacent to the input port and extending away from the input port; wherein:

the housing comprises a left side and a right side;

the dispensation unit extends laterally between the left side and the right side;

the input port is disposed at one of the left side and the right side of the housing;

the fluid inlet is in fluid communication with the input port and is disposed at one of the left side and the right side of the housing adjacent the input port;

the at least one baffle extends from the at least one wall; and the at least one baffle is disposed at one of the left side and the right side of the housing and on the same side as the fluid inlet.

2. The head unit of claim 1 wherein:

said at least one wall comprises a pair of sidewalls and a top wall; and said at least one baffle extends upwardly from the top wall and is disposed between the sidewalls.

3. The head unit of claim 2 wherein said at least one baffle is disposed between the sidewalls.

4. The head unit of claim 3 wherein:

the top wall extends between the pair of sidewalls; and said at least one baffle extends upwardly from the top wall.

5. The head unit of claim 2 further comprising a cover wall that extends between the sidewalls and cooperates with one of the sidewalls to define the elongated dispensation outlet.

6. The head unit of claim 1 wherein:

said at least one baffle has a length and a height; and the height of said at least one baffle decreases over a portion of its length.

7. The head unit of claim 1 further comprising a rotary member rotatably coupled with the housing and rotatable about a rotational axis, the rotary member being positioned adjacent the dispensation unit and configured to collect the fluid dispensed from the elongated dispensation outlet onto a surface.

8. The head unit of claim 7 further comprising a collection container associated with the housing and configured to collect the dispensed fluid from the rotary member.

9. The head unit of claim 8 wherein the collection container further comprises an elongated wiper that contacts the rotatable member and facilitates removal of collected fluid from the rotatable member during rotation of the rotatable member.

10. The head unit of claim 8 wherein the collection container is removable from the housing.

11. A head unit for a surface-treatment apparatus, the head unit comprising:

a housing comprising:

a fluid inlet for receiving fluid from a fluid reservoir;

a dispensation unit defining a dispensation chamber and an input port in fluid communication with each of the dispensation chamber and the fluid inlet, the dispensation unit defining an elongated dispensation outlet for the fluid; and at least one baffle disposed within and extending into the dispensation chamber, said at least one baffle being configured to direct the flow of fluid through the dispensation unit and out of the elongated dispensation outlet;

a rotary member rotatably coupled with the housing and rotatable about a rotational axis, the rotary member being positioned adjacent the dispensation unit and configured to collect the fluid dispensed from the elongated dispensation outlet; and a collection container associated with the housing and configured to collect the fluid from the rotary member; wherein:

the housing comprises a left side and a right side;

the dispensation unit extends laterally between the left side and the right side;

the input port is disposed at one of the left side and the right side of the housing;

the fluid inlet is in fluid communication with the input port and is disposed at one of the left side and the right side of the housing adjacent the input port;

the at least one baffle extends from the at least one wall; and the at least one baffle is disposed at one of the left side and the right side of the housing and on the same side as the fluid inlet.

12. The head unit of claim 11 wherein:

the dispensation unit comprises a pair of sidewalls; and the height of said at least one baffle decreases over a portion of its length.

13. The head unit of claim 12 further comprising a cover wall that extends between the sidewalls and cooperates with one of the sidewalls to define the elongated dispensation outlet.

14. The head unit of claim 11 wherein:

said at least one baffle has a length and a height; and the height of said at least one baffle increases over its length.

15. The head unit of claim 11 wherein the collection container further comprises an elongated wiper that contacts the rotatable member and facilitates removal of collected fluid from the rotatable member during rotation of the rotatable member.

16. The head unit of claim 11 wherein said at least one baffle originates at the input port and extends away from the input port.

17. A surface-treatment apparatus comprising:

a body;

a motor coupled with the body;

a fluid reservoir coupled with the body and configured to store fluid therein; and a head unit operably coupled with the motor, the head unit comprising:

a housing that comprises:

a fluid inlet for receiving fluid from the fluid reservoir;

a dispensation unit defining a dispensation chamber in fluid communication with the fluid inlet, the dispensation unit defining an elongated dispensation outlet for the fluid; and at least one baffle disposed within and extending into the dispensation unit, said at least one baffle being configured to direct the flow of fluid through the dispensation unit and out of the elongated dispensation outlet;

a rotary member rotatably coupled with the housing and operably coupled with the motor, the rotary member being rotatable about a rotational axis and positioned adjacent the elongated dispensation outlet, the rotary member being further configured to collect the fluid dispensed from the elongated dispensation outlet; and a collection container associated with the housing and configured to collect the dispensed fluid from the rotary member; wherein:

the housing comprises a left side and a right side;

the dispensation unit extends laterally between the left side and the right side;

the fluid inlet is disposed at one of the left side and the right side of the housing;

the at least one baffle extends from the at least one wall; and the at least one baffle is disposed at one of the left side and the right side of the housing and on the same side as the fluid inlet.

18. The surface-treatment apparatus of claim 17 wherein the head unit is releasably coupled with the motor and the body.

* * * * *